United States Patent [19]

Kemp, Jr. et al.

[11] Patent Number: 4,705,560

[45] Date of Patent: Nov. 10, 1987

[54] PROCESS FOR PRODUCING METALLIC POWDERS

[75] Inventors: Preston B. Kemp, Jr., Athens; Walter A. Johnson, Towanda; James Q. Steigelman, Athens, all of Pa.

[73] Assignee: GTE Products Corporation, Stamford, Conn.

[21] Appl. No.: 918,182

[22] Filed: Oct. 14, 1986

[51] Int. Cl.[4] ..... B22F 9/00

[52] U.S. Cl. ..... 75/0.5 B; 75/0.5 BA; 75/0.5 BB; 75/0.5 BC; 75/0.5 C; 264/15

[58] Field of Search ..... 75/0.5 R, 0.5 B, 0.5 BA, 75/0.5 BB, 0.5 BC, 0.5 C; 264/15

[56] References Cited

U.S. PATENT DOCUMENTS 3,776,704 12/1973 Benjamin ..... 75/0.5 R
3,778,249 12/1973 Benjamin ..... 75/0.5 R
3,809,545 5/1974 Benjamin ..... 75/0.5 R

*Primary Examiner*—Wayland Stallard
*Attorney, Agent, or Firm*—Donald R. Castle; L. Rita Quatrini

[57] ABSTRACT

A process is disclosed for producing essentially spherical metallic powder particles. The process involves mechanically agglomerating a mixture comprising powders wherein the powders are selected from the group consisting of metals, metal alloys, metal-ceramic composites, ceramics, and wherein at least one of the powders is a relatively ductile and/or malleable metal. The resulting mechanically agglomerated powder particles are entrained in a carrier gas and passed through a high temperature zone at a temperture above the melting point of the lowest melting component of the mixture to melt at least about 50% by weight of the mechanically agglomerated particles and form essentially spherical powder particles of the melted portion, followed by resolidifying the resulting high temperature treated material.

4 Claims, No Drawings

PROCESS FOR PRODUCING METALLIC POWDERS

This invention relates to a process for producing powders which contain at least one ductile and/or malleable metal and which are essentially spherical in shape. More particularly, the process involves a mechanical agglomeration step prior to high temperature processing. Still more particularly, the high temperature process is a plasma process.

BACKGROUND OF THE INVENTION

Up to this time, agglomeration of powders was achieved via spray drying, fluid bed agglomeration, or granulation.

While these techniques are extremely useful for virtually any powder, agglomerate, or batch size, they have the disadvantage of requiring an organic binder system to bring about particle adherence. The agglomerates must be subjected to dewaxing operations to remove the binder which often leaves behind a carbonaceous residue. In addition, the agglomerates must be sintered after dewaxing to produce adequate strength for subsequent processing.

In high temperature processing, in particular plasma processing of spray dried agglomerates, the possibility exists for incomplete alloying. This is due to the presence of an oxide film on the metal particles. This film is difficult to rupture using standard spray drying, fluid bed, and granulation agglomeration methods.

Therefore, a process for producing powder particles, in particular metallic powders without the above disadvantages would be advantageous.

SUMMARY OF THE INVENTION

In accordance with one aspect of this invention, there is provided a process for producing essentially spherical metallic powder particles. The process involves mechanically agglomerating a mixture comprising powders wherein the powders are selected from the group consisting of metals, metal alloys, metal-ceramic composites, ceramics, and wherein at least one of the powders is a relatively ductile and/or malleable metal. The resulting mechanically agglomerated powder particles are entrained in a carrier gas and passed through a high temperature zone at a temperature above the melting point of the lowest melting component of the mixture to melt at least about 50% by weight of the mechanically agglomerated particles and form essentially spherical powder particles of the melted portion, followed by resolidifying the resulting high temperature treated material.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

This invention provides for a process for producing essentially spherical metallic powder particles by mechanical agglomerating followed by high temperature processing. The metallic components are alloyed in the high temperature processing step.

The preferred mechanical agglomerating process involves milling a mixture comprising powders, one of which is a ductile and/or malleable metal.

The component powders of the mixture can be metals, metal alloys, metal-ceramic composites, and ceramics. The mixture can have additives such as metal or non-metal oxides, nitrides, borides, carbides, silicides, as well as complex compounds such as carbonitrides. Preferred powders are iron, iron alloys, aluminum, titanium, cobalt, boron containing alloys, copper, nickel, molybdenum, and tungsten. Preferred ductile metals are iron, iron alloys, aluminum, titanium, cobalt, copper, and nickel.

The mechanical agglomeration can be accomplished by methods as attritor, tumbling, rotary, milling or vibratory milling. Preferred methods are attritor ball milling, tumbling ball milling, rotary ball milling, vibratory ball milling with attritor ball milling, being the especially preferred method.

A preferred attritor mill is manufactured by Union Process under the trade name of "The Szegvari Attritor". This mill is a stirred media ball mill. It is composed of a water jacketed stationary cylindrical tank filled with small ball type milling media and a stirrer which consists of a vertical shaft with horizontal bars. As the stirrer rotates, balls impact and shear against one another. If metal powder is introduced into the mill, energy is transferred through impact and shear from the media to the powder particles, causing cold work and fracture fragmentation of the powder particles. The milling process may be either wet or dry, with dry milling being the preferred technique.

The milling conditions are designed to promote cold welding, agglomeration, and fracture of the agglomerates.

Specific milling conditions depend on factors such as nature and amount of the powders, design and size of the equipment, etc.

Mechanical agglomeration results in production of agglomerates which are relatively uniform in chemical composition throughout the agglomerate. This is an advantage over the conventional agglomeration technique of spray drying followed by dewaxing and sintering which are eliminated by this invention. The process of this invention is especially advantageous in making relatively uniform agglomerates of metal powders in which one or more components are present in a small amount, for example, in Fe with about 2% by weight Ni. Materials which contain aluminum which is difficult to alloy by standard high temperature powder processing methods because of the presence of an oxide film, are effectively alloyed by the process of this invention because of the mechanical agglomeration. The problem of oxide films is avoided by the process of this invention because the mechanical agglomeration can be accomplished in an inert environment. Also, when the component powder particles are brought into intimate contact, their surface oxide films break causing mechanical adherence, and/or welding and make it easier to fully melt the agglomerate during the subsequent high temperature process.

The resulting mechanically agglomerated powder particles are then entrained in a carrier gas and passed through a high temperature zone at a temperature above the melting point of the lowest melting component of the powder to melt at least about 50% by weight of the mechanically agglomerated particles and form essentially spherical powder particles of the melted portion. Some additional particles can be partially melted or melted on the surface and these can be spherical particles in addition to the melted portion. The preferred high temperature zone is a plasma.

Details of the principles and operation of plasma reactors are well known. The plasma has a high temperature zone but in cross section, the temperature can vary typically from about 5500° C. to about 17,000° C. The outer edges are at low temperatures and the inner part is at a higher temperature. The retention time depends upon where the particles entrained in the carrier gas are injected into the nozzle of the plasma gun. Thus, if the particles are injected into the outer edge, the retention time must be longer, and if they are injected into the inner portion, the retention time is shorter. The residence time in the plasma flame can be controlled by choosing the point at which the particles are injected into the plasma. Residence time in the plasma is a function of the physical properties of the plasma gas and the powder material itself for a given set of plasma operating conditions and powder particles. Larger particles are more easily injected into the plasma while smaller particles tend to remain at the outer edge of the plasma jet or are deflected away from the plasma jet.

As the material passes through the plasma and cools, it is rapidly solidfied.

The above described plasma melting rapid solidification (PMRS) process offers an alternative to ladle metallurgy alloying followed by atomization.

To more fully illustrate this invention, the following non-limiting examples are presented.

EXAMPLE 1

If a "stainless steel" agglomerate is desired, then the ternary constituent powder particles of iron, chromium, and nickel are placed in an attritor mill with an appropriate solvent such as heptane or dry milled with an inert gas purge and an appropriate milling media such as tungsten carbide.

EXAMPLE 2

Making of $Fe_3Al$ Particles

About 0.35 kg −325 mesh gas atomized Al powder is milled at about 180 rpm in about 3.5 liters of heptane using tungsten carbide ¼" diameter media for about 2 hours. About 2.15 kg of water atomized Fe powder is added with about 0.5 liters of heptane. The Al—Fe mixture is milled for about 3 hours at the same speed (180 rpm). The mill speed is reduced to from about 140 to about 150 rpm, and milling is continued for about another 18 hours. The resulting milled material is dried, screened, air classified, and then plasma processed, followed by air classification to the desired particle size.

While there has been shown and described what are at present considered the preferred embodiments of the invention, it will be obvious to those skilled in the art that various changes and modification may be made therein without departing from the scope of the invention as defined by the appended claims.

What is claimed is:

1. A process for producing essentially spherical metallic powders particles, said process comprising:

(a) mechanically agglomerating a mixture comprising powders, wherein said powders are selected from the group consisting of metals, metal alloys, metal-ceramic composites, ceramics, and wherein at least one of said powders is a relatively ductile and/or malleable metal;

(b) entraining the resulting mechanically agglomerated powder particles in a carrier gas and passing said mechanically agglomerated particles through a high temperature zone at a temperature above the melting point of the lowest melting component of said mixture to melt at least about 50% by weight of said mechanically agglomerated particles and form essentially spherical powder particles of said melted portion; and (c) resolidifying the resulting high temperature treated material.

2. A process of claim 1 wherein said high temperature zone is a plasma.

3. A process of claim 1 wherein the mechanical agglomeration step is done by methods selected from the group consisting of attritor, tumbling, rotary, and vibratory milling.

4. A process of claim 3 wherein said mechanical agglomeration step is done by ball attritor milling.

* * * * *